US005183478A

United States Patent [19]

Holland et al.

[11] Patent Number: 5,183,478

[45] Date of Patent: Feb. 2, 1993

[54] PROCESS FOR DEWATERING QUENCHED SLAG

[75] Inventors: Douglas K. Holland, Rialto, Calif.; Edward W. Dillingham, McFarland, Kans.

[73] Assignee: Texaco Inc., White Plains, N.Y.

[21] Appl. No.: 655,612

[22] Filed: Dec. 15, 1991

[51] Int. Cl.[5] ..... C10J 3/08

[52] U.S. Cl. ..... 48/197 R; 48/210; 48/DIG. 2; 110/165 R; 110/171

[58] Field of Search ..... 48/197 R, 206, 209, 48/210, DIG. 2, 87, 197 A; 110/165 R, 167, 171; 210/800, 803; 414/216; 252/373

[56] References Cited

U.S. PATENT DOCUMENTS

| | | | |
|---|---|---|---|
| 2,118,157 | 5/1938 | Camp | 210/800 |
| 3,607,157 | 9/1971 | Schlinger et al. | 48/206 |
| 3,950,146 | 4/1976 | Funk | 48/197 R |
| 3,962,978 | 6/1976 | Bosman | 110/165 R |
| 3,994,702 | 11/1976 | Schweimanns et al. | 48/197 R |
| 4,227,469 | 10/1980 | Collura | 110/160 R |
| 4,838,898 | 6/1989 | Mifflin et al. | 48/206 |

*Primary Examiner*—Peter Kratz

*Attorney, Agent, or Firm*—Robert A. Kulason; James J. O'Loughlin; Robert B. Burns

[57] ABSTRACT

Quenched slag discharged from a gasification process such as a coal gasification process can be continually dewatered and removed without disrupting operations by alternately discharging the quenched slag from means such as lockhoppers and directing the slag to one of two disengagement zones symmetrically arranged on either side of a clear water pit. The slag settles along a sloping active disengagement zone, allowing water to separate and drain into an adjacent slag pit. The accumulated water is drained into the clear water pit through vertically-spaced drains in the walls separating the slag pits from the clear water pit and pumped away after solids have settled. After an active disengagement zone-slag pit is used for a period of time, perhaps 24 hours, the discharge of slag is redirected to the other such area while dewatered slag is removed from the first slag pit.

9 Claims, 3 Drawing Sheets

PROCESS FOR DEWATERING QUENCHED SLAG

BACKGROUND OF THE INVENTION

1. Field of the Invention

This invention relates to methods and apparatus for dewatering quenched slag, such as slag discharged from the lockhoppers or other systems for dumping slag which has been quenched in water after generation in coal gasification systems or the like.

2. Information Disclosure Statement

Due to political and economic events, the United States has endured several energy crises in recent history. Some industries have found it expedient to utilize equipment which allows the use of alternate fuels, e.g., petroleum fuel oils or natural gas, according to availability or economics. Historically, the most available and economical source of motor fuels has been the refining of petroleum, although nations such as Nazi Germany and South Africa have found it necessary to employ sources of synthetic fuels such as coal from time to time. As economically available domestic and foreign sources of petroleum and natural gas dwindle, the strategic and economic value of America's vast coal reserves increases. In addition to the logistic and economic problems of recovering and transporting such resources to the point of use, the problems of coal use include atmospheric emissions and the disposition of large volumes of ashes and slag, which may allow heavy metals and other pollutants to be leached out by water.

In a typical coal gasification plant, a particulate fuel slurry containing coal is delivered to a gasifier where it is combined with oxygen to form a synthesis or fuel gas ("syngas") by a partial oxidation reaction. The operating temperature is generally maintained sufficiently above the ash fusion temperature to ensure that the slag generated is in a free-flowing molten state. The hot crude syngas generated is subjected to high temperature gas cooling or quenching when it is introduced, together with the molten slag, into radiant syngas coolers or quench sump(s).

Typical radiant coolers are disclosed in coassigned U.S. Pat. Nos. 2,896,927 and 2,818,326, which are incorporated herein by reference. These coolers generate high pressure steam and a cleaned gas which is directed to convective coolers. In the "direct quench" type plant, as described, e.g., in U.S. Pat. No. 4,052,176 (col. 4), the hot crude syngas is directly quenched in water. The molten slag drops to the bottom of the radiant coolers where it is quenched in a water pool (common to both gasifier configurations), forming a coarse slag which settles at the bottom of the sumps. The quenched slag is periodically discharged through a water-filled lockhopper system. Typically, the slag-water mixture discharged from the lockhoppers is discharged to a slag sump tank where the slag is allowed to settle in the accumulated water. The settled slag is then removed by drag conveyor or similar transport systems to a concrete-lined area for truck loading and the clarified water is pumped to filters which remove fine particulate matter (fines). Although such systems are operational, they have numerous disadvantages; for example, reliable and sturdy drag conveyor systems are expensive and require frequent maintenance and repair due to the large volumes of heavy, abrasive and corrosive slag handled. The typical flat-bottomed slag sump tank is difficult to empty of slag liquids and accumulated fines, and periodic shutdowns may be required if only one sump tank system is available for dumping of slag from the lockhoppers.

Inadequately drained slag can have up to 60 to 70 weight percent water. Thoroughly drained slag contains about 25 percent water and appears dry. Even after 30 days in the dry desert atmosphere slag can contain as much as 14 percent water. When inadequately drained slag is loaded into trucks water can drain out during loading and transport to the eventual disposal site. Such drainage of water with accompanying fines onto the loading site and the roadways increases the problems of site clean-up and reduces the amount of dry slag that the truck can transport per trip because of the added weight of unwanted water. Furthermore, when the wet slag is loaded into a truck the seepage of water interferes with the seating of the dumpster or tailgate surfaces because the fines prevent a tight fit. Unless the equipment is thoroughly hosed down, the improper seating of the mating surfaces aggravates spillage during transport.

Clearly, improved methods of dewatering, transporting and disposing of quenched slag and similar particulate materials containing excess aqueous liquids are needed.

SUMMARY OF THE INVENTION

It is an object of the present invention to provide improved methods and apparatus for dewatering and removing the quenched slag which is dumped from the radiant coolers and quench sumps of coal gasification systems, and for handling similar particulate solids containing excess water. A further object of the invention is to provide such methods which will allow the continuous operation of coal gasification plants, without shutdowns or interruptions being necessary for the processing of slag.

In accordance with the invention, a process for continuous removal of quenched slag from a fuel gasification process employing at least one gasifier with discharge means for dumping said slag and water together with two slag pits, comprises steps of:

(a) periodically discharging the quenched slag and water from the discharge means onto the upper portion of a disengagement zone of a first slag pit having a sufficient downward slope to allow free and absorbed water to separate from the dumped slag and flow through the disengagement zone into a lower portion of the slag pit having a plurality of vertically-spaced water-draining means;

(b) allowing the wet slag to accumulate and drain for a first period of time;

(c) shifting the discharge of the slag and water from the first disengagement zone and slag pit to a second disengagement zone and slag pit for a second period of time;

(d) removing the drained slag from the first disengagement zone by loading and transport means, beginning with the driest portions thereof;

(e) draining accumulated water from the first and second slag pits into a clear water pit via drainage means; and (f) allowing solids to settle in the water accumulated in the clear water pit, periodically removing the clear water and settled solids; wherein the first and second slag pits are alternately used as active pits for dumping and drainage of slag, with the non-active pit being cleared as in step (d) in less time than the active pit is permitted to accumulate slag.

The process of the present invention can be conducted as a two-day operation, with slag being fed to one pit during one day while the second pit is being cleaned out. There is a distinct advantage of separating the active, that is, receiving zone, from the non-active, i.e. clean out zone. The active zone can be sealed and vapor emissions regulated. Workers in the clean out zone are thus not subjected to emissions arising from normal operations. The hot water discharged with slag does generate vapor which may contain harmful gases. For example, there can be a distinctive odor of ammonia.

Further in accordance with the invention, apparatus for the improved draining and removal of quenched slag dumped from the lockhoppers of a coal gasification unit is provided, comprising:

(a) two slag pits and associated disengagement zones symmetrically arranged on either side of a clear water pit, these disengagement zones sloping downward toward the lower portions of the slag pits, with the upper portions of the disengagement zones sloping laterally inward toward the clear water pit;

(b) two walls to separate the clear water pit from the slag pits and retain liquids, these walls each containing a plurality of vertically-spaced drainage means which can be independently opened to drain water from either of the slag pits into the clear water pit; and (c) pump means to remove water drained into the clear water pit.

A preferred embodiment of the invention is an apparatus for the gasification of fuel slurries comprising coal, comprising at least one gasifier having at least one lockhopper each of which is adapted to discharge quenched slag and water from the process into at least one dump chute and thence onto the upper portion of a disengagement zone of a first slag pit which slopes downward and laterally inward toward an adjacent wall partially defining a clear water pit, with a second wall of the clear water pit adjoining a second disengagement zone and slag pit symmetrically located opposite the first, the first and said second walls containing a plurality of vertically-spaced drainage means for draining water from the slag pits into the clear water pit, wherein the clear water pit comprises means for removing the accumulated water, the gasification system further comprising means of periodically redirecting the discharge of quenched slag and water from the dump chute to the first or second disengagement zones.

BRIEF DESCRIPTION OF THE DRAWINGS

Other objects and advantages of the present invention will become apparent to persons skilled in the art upon perusal of the following detailed description, including the appended claims and the drawing, in which:

DETAILED DESCRIPTION OF THE INVENTION

Figure 1:
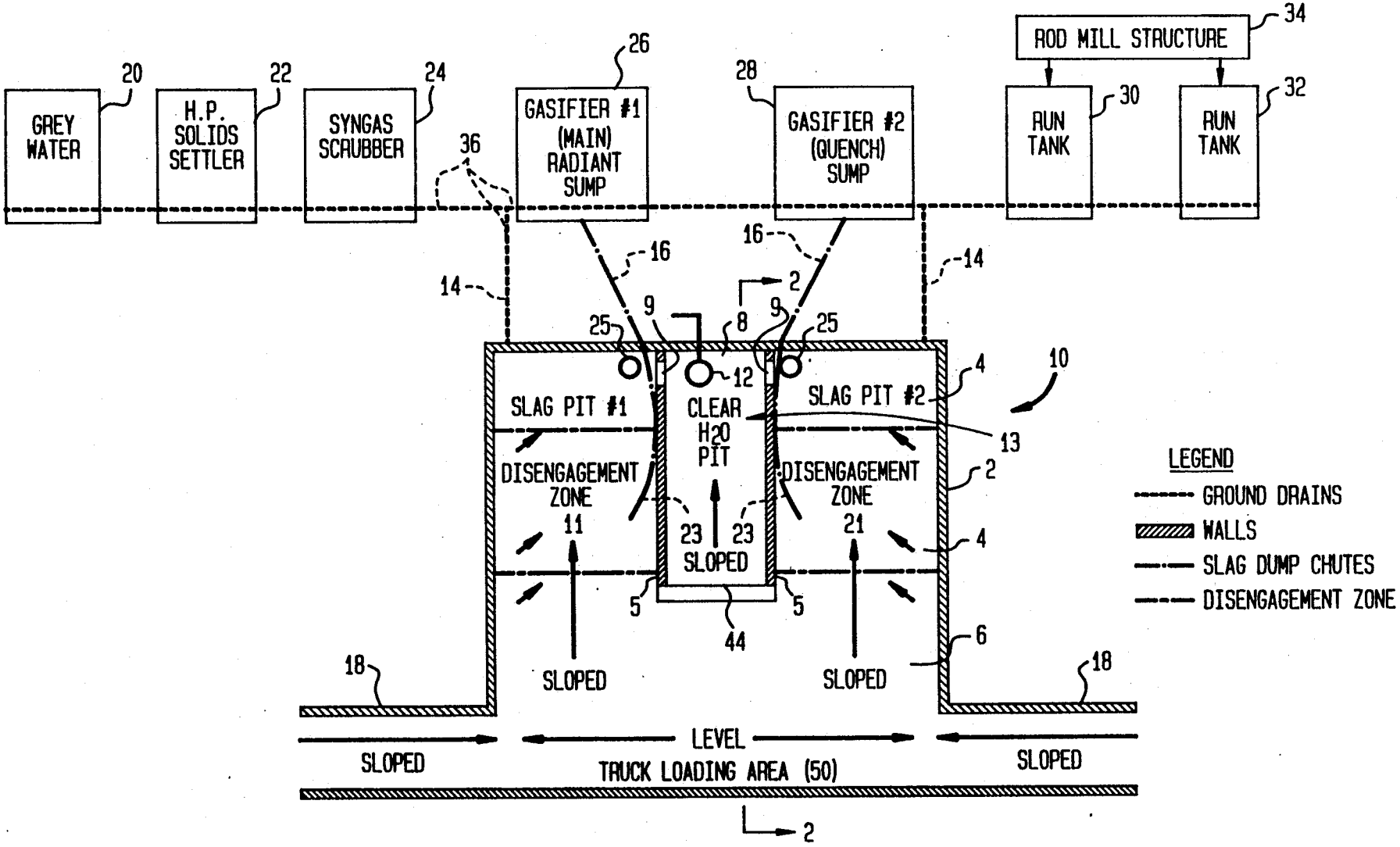
FIG. 1 is a top view of a dual slag pit system designed to provide for improved dewatering of quenched slag as discharged from a coal gasification system.

Although the present invention will be illustrated by application to the processing of slag discharged from a coal gasification process in which synthesis gas is produced from coal by a process of gasification or partial oxidation, it must be emphasized that the method and apparatus of the invention are broadly applicable to the continuous treatment of any continuing flow of particulate matter containing excess water and requiring dewatering and efficient disposition.

Referring now to the drawing,

FIG. 1 shows a partial schematic diagram of a coal gasification system with a dual slag pit dewatering system for processing and disposing of slag and water as discharged from the gasifiers. The first gasifier (26) and optionally the second gasifier (28) are supplied with a slurried solid fuel from at least one run tank (30) and (32). These solid fuels are ground in a rod mill (34) or other suitable grinder and are combined with water or other suitable liquids (not shown) in the run tanks, then conveyed to the gasifiers by conventional slurry pumps (not shown).

Although this description and the examples herein are directed specifically to coal gasification processes, the present invention can be applied to the disposition of slag contained from a variety of solid fuels which are slurried and subjected to partial oxidation in the gasifier.

A wide range of combustible carbon-containing organic materials may be reacted in the gas generator with a free-oxygen containing gas, optionally in the presence of a temperature moderating gas, to produce an effluent gas stream. The term hydrocarbonaceous as used herein to describe various suitable feedstocks to the partial oxidation gas generator is intended to include solid hydrocarbons, carbonaceous materials, and mixtures thereof. In addition, gaseous or liquid hydrocarbons can be absorbed in or absorbed on such solid particulate materials to add fuel value, so long as the ability of the fuel to form an aqueous slurry is not impaired. In fact, substantially any combustible carbon containing organic materials, fossil fuel, or slurries thereof, may be included within the definition of the term "hydrocarbonaceous". For example, there are pumpable slurries of solid carbonaceous fuels, such as coal, lignite, particulate carbon, petroleum coke, concentrated sewer sludge, and mixtures thereof in water or a liquid hydrocarbon. The hydrocarbonaceous fuel may have a sulfur content in the range of from 0 to about 10 weight percent and an ash content in the range of from 0 to about 15 weight percent.

The term liquid hydrocarbon, as used herein to describe suitable liquid feedstocks, is intended to include various materials, such as liquified petroleum gas, petroleum distillates and residues, gasoline, naphtha, kerosene, crude petroleum, asphalt, gas oil, residual oil, tar sand oil and shale oil, coal derived oil, aromatic hydrocarbons (such as benzene, toluene, xylene fractions, etc.), coal tar, cycle gas oil from fluid-catalytic-cracking operations, furfural extracts of coker gas oil, and mixtures thereof. Gaseous hydrocarbon fuels, as used herein to describe suitable gaseous feedstocks, include methane, ethane, propane, butane, pentane, natural gas, water-gas, coke-oven gas, synthesis gas, and mixtures thereof. Both gaseous and liquid feeds may be mixed and used simultaneously to pretreat solid fuel components and may include paraffinic, olefinic, naphthionic, and aromatic compounds in any proportion. Liquid hydrocarbons such as coal-derived oils and other heavy oils can be useful in stabilizing aqueous coal slurries, perhaps through selective agglomeration.

Also included within the definition of the term hydrocarbonaceous are oxygenated hydrocarbonaceous organic materials including carbohydrates, cellulosic materials, aldehydes, organic acids, alcohols, ketones, oxygenated fuel oil, waste liquids and by-products from chemical processes containing oxygenated hydrocarbonaceous organic materials and mixtures thereof.

The term solid carbonaceous fuels, as used herein to describe suitable solid carbonaceous feedstocks, is intended to include high rank fuels selected from the group consisting of anthracite coal, bituminous coal, coke from coal, char from coal, coal liquefaction residues, particulate carbon, petroleum coke, solids derived from oil shale, tar sands and pitch; and/or low rank fuels selected from the group consisting of sub-bituminous coal, lignite, peat, concentrated sewer sludge, bits of garbage, wood, and mixtures thereof.

Any suitable grinding system may be used to convert the solid carbonaceous fuels or mixtures thereof to the proper size. The solid carbonaceous fuels are preferably ground to a suitable particle size.

The gasifier(s) produce(s) syngas which is passed through a syngas scrubber (24) and thence to other units for further treatment or combustion (not shown). High pressure solids settler (22) settles out solids entrained in water from the syngas scrubber (24), with the water passing into the separated gray water vessel (20). Ground drains (36) are provided to direct excess or leaking liquids from these vessels to the slag pits via lines (14).

Figure 2:
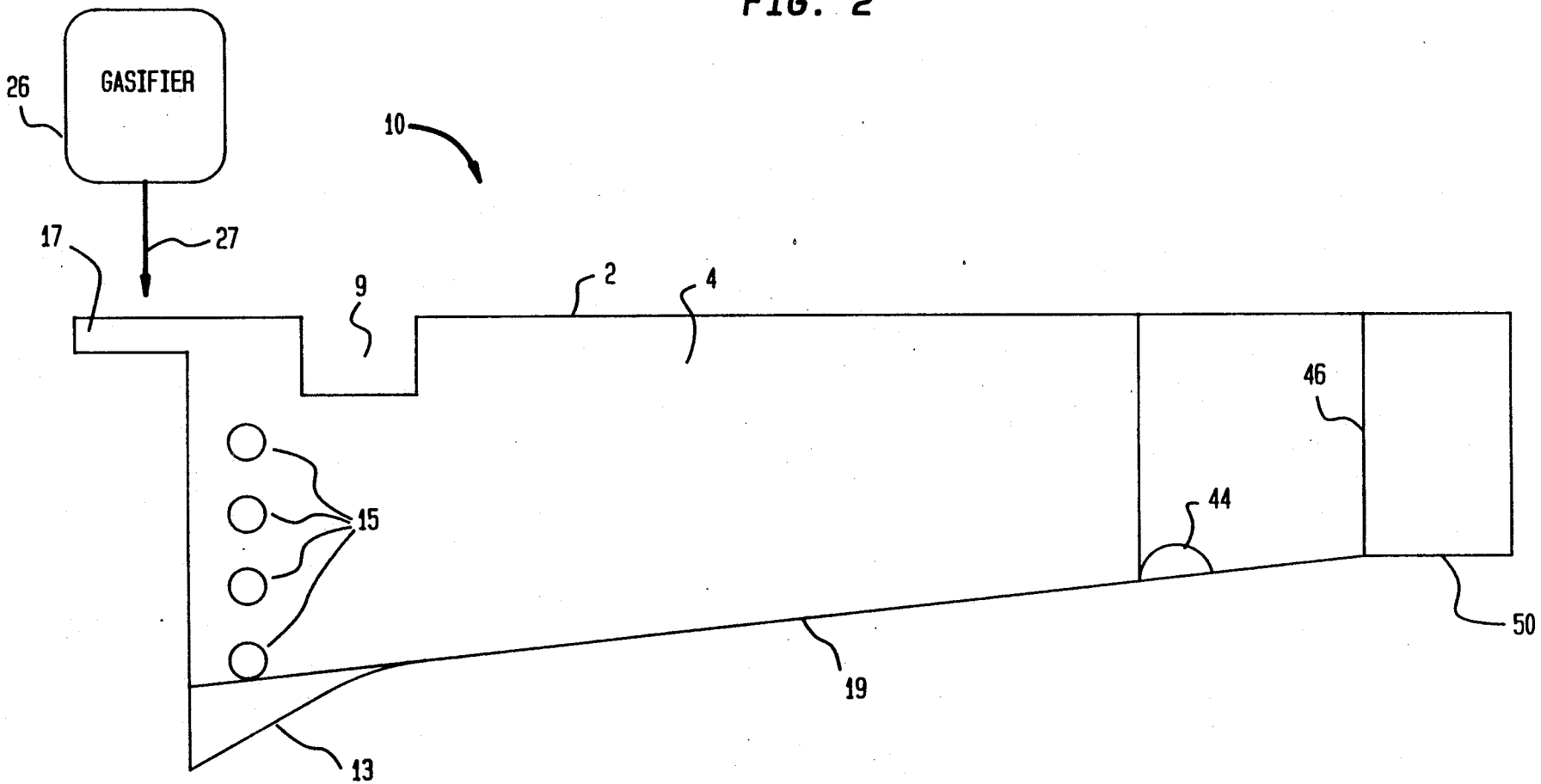
FIG. 2 is a side view showing the dual sloped disengagement zones and slag pits for the above system and a wall defining an adjacent clear water pit having a progressively steeper downward slope.
Figure 3:
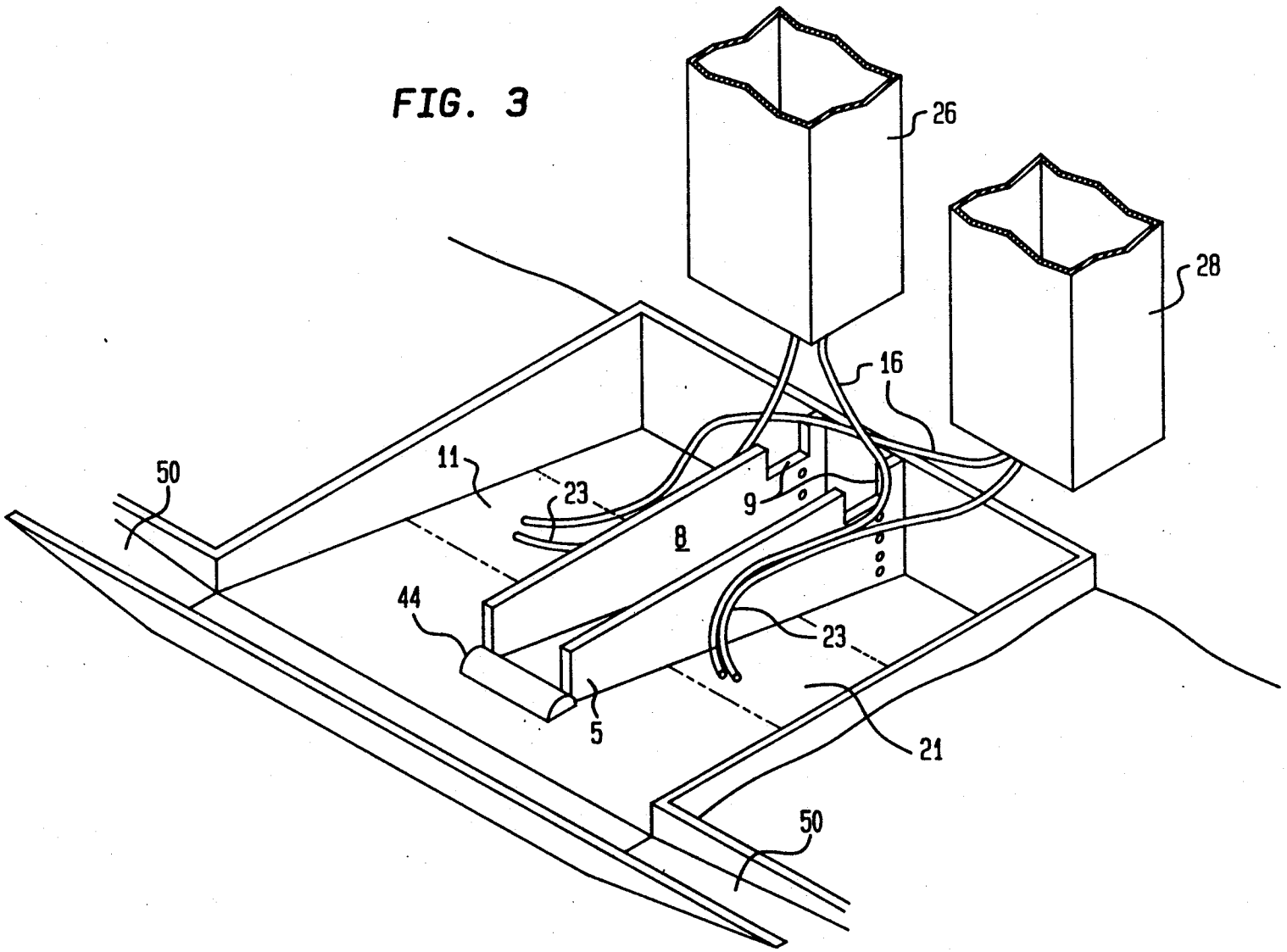
FIG. 3 is an elevated perspective view of the system of FIGS. 1 and 2 which has been simplified to illustrate the arrangement of the gasifiers relative to the dual slag pits.

As indicated in FIGS. 1, 2 and 3, the gasifiers are located above these slag pits and associated ramps and are positioned so that slag discharged from the lockhoppers of either gasifier (when two gasifiers are provided) can be directed to the upper portions of the sloped disengagement zones (11,21) located on either side of the clear water pit wall (5) and below hump (44). These sloped ramps lead to either slag pit (1) or (2). To provide for placement of discharged slag from either set of lockhoppers to either one of the two dumping pads at various times, dedicated or movable dump chutes, conveyor belts or other suitable mechanical means are provided for directing the slag from the lockhoppers to the designated disengagement zone(s).

In the system shown in FIGS. 1, 2 and 3, the slag dump chutes (23) preferably travel along the clear water pit walls and then angle outward and downward to the upper portions of the disengagement zones for optimum separation and placement of the slag away from the clear water pit.

As indicated in FIG. 1, the disengagement zones (11,21) for each slag pit slope downward to each pit as well as laterally inward to the clear water pit. To handle the slag from a typical gasification process, these disengagement zones can be approximately 40 to 50 feet wide. The disengagement zones should also slope inward at a grade of at least about 1 percent, preferably about 2 percent. The truck loading areas (50) also slope inward at a slope of at least about 1 percent to a level area above the clear water pit (13), as shown in FIGS. 1 and 3. The level area where the trucks are loaded by front end loader preferably slopes downward slightly toward the slag pits to allow clean up water to flow to the pits. The hump (44) at the head of the clear water pit prevents solids from going down this ramp, directing them instead to the sloped disengagement zones leading to the sumps of slag pits (1) or (2).

As illustrated in FIGS. 1 and 2, a wall (5) separates the ramps and slag pits from the clear water pit (8). Disengagement zones (11) and (21) slope downward, allowing the wet slag and water to separate. The disengagement zones at the middle of the slag pits slope downward at a uniform grade of at least about 0.5 percent, preferably about 1.2 percent. The slope should be sufficient to allow water to readily separate from the slag without allowing a substantial portion of the slag to reach the bottom of the slag pits. The bottom of clear water pit (8) slopes downward, also at a grade of at least about 1 percent, with a grade sharply increasing to at least about 30 percent at (13) as indicated in FIGS. 1 and 2. A series of tri-cocks (15) are located in vertically-spaced configurations in the two walls defining the clear water pit, so that as water accumulates in the slag pit which is in use, the tri-cocks can be opened to discharge water into the clear water pit. If the level of the water rises above the level of the tri-cocks in either slag pit, it passes through overflows (9) into the clear water pit. Accumulated water is removed from the clear water pit by pump (12) after solids have been allowed to settle. Additionally, floating pumps (25) can be used to remove water from the surface of the liquids accumulated in either slag pit if desired.

The operation of the system in the dewatering and removal of slag from the system is as follows:

At the initial plant start up, operating liquid levels in the clear water pit can be established via the dedicated ground drains and maintained with one of the three tri-cocks during the completion of the start-up checklist which requires the draining and flushing of all solids handling vessels and/or associated piping prior to establishing normal operating levels in these areas. A front end loader or other suitable vehicle for scooping up the slag and loading into a truck for transport is pre-positioned. A dump chute to direct slag from the lockhopper in use is positioned or aligned to dump slag into the selected slag pit (1) or (2). In the operation of the gasifier systems, the lockhopper system completes the cycle approximately every 30 minutes by dumping quenched slag in water onto one of the two concrete pads, typically a 50 foot by 85 foot run on a 1.2 percent grade, with a 50 by 40 foot disengagement zone of the same grade, which allows the free water portion of each dumped load of slag and water to flow according to gravity to the lowest point in the active slag pit. Dumping of this type can continue non-stop for a period of at least a day, or up to about 48 hours, at which time the backup lockhopper dump chute is aligned to the standby or alternate slag pit so that slag can be dumped and processed in the other pit while the previously-employed pit is cleared.

After the backup dump chute has been positioned to dump slag on the standby slag pit, a front end loader or other suitable vehicle will begin removing the driest slag which is collected on the disengagement zone, i.e. the material located farthest from the low point of the slag pit, and loading into a truck or other transporter which is positioned a short distance above the floor of the slag pit on level concrete. Preferably, the truck or trailer is positioned so that it can be hosed clean with recycle clear water, thus leaving all slag solids in the slag pit prior to transporting the load offsite. By operating with each slag pit for a period of at least several hours or normally about 24 hours, the slag in the disengagement zone can be well drained and the water separated into the clear water pit. Any slag fines which were carried into the active slag pit will have settled into the lowest points, so that the water can be separated by using the tri-cocks.

The clear water pit (8), typically a 20 foot by 65 foot run on about a 1.5 degree grade, receives solids-free water from the active slag pit during and after every lockhopper dump via the tri-cock network. The overflows provided in the walls of the clear water pit allow a greater slag storage capacity in the active slag pit as required, by allowing removal of the clear water as it separates from the slag. The lowest point in the clear water pit, typically a 5 by 50 foot run on at least about a 30 percent grade, insures that the clear water pit pumps will always have a solid-free liquid to pump. The pumps are operated on "level control". Furthermore, the slag pit being cleaned while the other pit is active can remove as much water as required from its lowest point via the bottom tri-cock. The clear water pit walls preferably have barrier protection since they are the only free standing walls within the slag pits. The pits are preferably constructed below grade to improve wall support and truck access. Such designs also permit the ground drains to drain directly into the pits. Concrete hump (44) is positioned at the open end of the clear water pit to prevent slag from being washed into the clear water pit during the loading of the trailer and hosing down that location, as well as protecting the clear water pit from loose slag which might enter during dumping in the active pit.

EXAMPLES

The invention is further illustrated by the following hypothetical and comparative examples, in which the advantages of certain embodiments of the invention will be apparent in contrast to a prior art method.

COMPARATIVE EXAMPLE A

At Cool Water (a commercial demonstration of coal gasification operated by Applicant's assignee, et al at Daggett, Calif.) the slag receiving area involved a single pit with a slope of 5 percent. This grade proved to be excessive. When the slag/water mixture was discharged from the lockhopper, the water drained rapidly from the slag and the fines generally accompanied the water. The fines settled downstream from the slag and built in effect a dam that prevented proper draining of the main body of slag. The Cool Water single pit design provided neither adequate time nor room to allow the separation of water from the slag as noted. A portion of the water was left trapped. This made subsequent loading of the slag into a disposal truck sloppy and increased slag transportation difficulties.

HYPOTHETICAL EXAMPLE 1

A coal gasification process is operated with a single gasifier and a dual-pit slag separation system by operating the gasifier for periods of approximately 24 hours with the lockhoppers discharging wet slag and water into a dump chute positioned to deposit the slag on the upper portion of the disengagement zone of the slag pit (as described above with reference to FIGS. 1 and 2) which is designated as active. At least one other slag pit is inactive. During the period of operation the disengagement zone is covered with slag and the water is substantially separated from the slag by gravity, drained into a clear water pit and pumped away.

At the appropriate time, the gasifier lockhoppers are redirected to a dump chute which will direct the quenched slag and water to the backup slag pit, which has been cleared of any slag and water during the period that the active pit was operating. The slag in the previously active pit is allowed any further time necessary for draining, then loaded into trucks for transport in less than 24 hours, making the previously active pit the backup pit, prepared to accept slag again at the next changeover.

The result is a more efficient process for draining and removing the slag off site, thus reducing untidy deposits of slag particles or fines resulting from truck spillage. More of the water used in the system is recycled, thus reducing daily net water requirements. Removing more of the water from the wet slag prior to transporting it elsewhere reduces power requirements for transport as well as saving water. Since each slag pit can be cleaned up in less time than it takes to fill the active slag pit, the gasification system can be kept operating indefinitely without allowing excessive amounts of slag to accumulate or shutting down for removal of such materials.

The process and apparatus of the present invention have been described generally and by examples with reference to a coal gasification process for purpose of clarity and illustration only. It will be apparent to those skilled in the art from the foregoing disclosure that various modifications of the process and the materials disclosed herein can be made without departure from the spirit of the invention.

What is claimed is:

1. A process for continuous removal of quenched slag from a fuel gasification process employing at least one gasifier with discharge means for dumping said slag and two slag pits, comprising steps of:

(a) periodically discharging said slag and water from said discharge means onto the upper portion of a disengagement zone of a first slag pit having a sufficient downward slope to allow free and absorbed water to separate from said slag and flow through said disengagement zone into a lower enclosed portion of said slag pit having a plurality of vertically-spaced water-draining means;

(b) allowing said slag to accumulate and drain for a first period of time;

(c) shifting the discharge of said slag and water from said first disengagement zone and slag pit to a second disengagement zone and slag pit for a second period of time;

(d) removing the drained slag from said first disengagement zone by loading and transport means, beginning with the driest portions thereof;

(e) draining accumulated water from said first and said second slag pits into a clear water pit via said drainage means; and (f) allowing solids to settle in the water accumulated in said clear water pit, periodically removing the clear water and settled solids;

wherein said first and second slag pits are alternately used as active pits for dumping and drainage of slag, with the non-active pit being cleared as in step (d) in less time than the active pit is permitted to accumulate slag.

2. The process of claim 1 wherein said fuel is a hydrocarbonaceous fuel and said gasifier employs a partial oxidation process.

3. The process of claim 2 wherein said hydrocarbonaceous fuel comprises at least one coal.

4. The process of claim 2 wherein said hydrocarbonaceous fuel comprises concentrated sewage sludge.

5. The process of claim 1 wherein said discharge means comprise lockhoppers.

6. The process of claim 1 wherein said quenched slag and water discharged are directed to said disengagement zone from said discharge means by dump chutes.

7. The process of claim 1 wherein said loading means and transport means comprise front end loaders and trucks.

8. The process of claim 1 wherein water is drained from said slag pits into said clear water pit via vertically-spaced tri-cocks, beginning with the highest-positioned tri-cocks so as to drain substantially clear water as solid materials settle in each of said slag pits.

9. The process of claim 1 wherein each slag pit is employed in succession as an active slag pit for periods of at least about 24 hours.

* * * * *